US009200477B2

(12) United States Patent
Dück

(10) Patent No.: US 9,200,477 B2
(45) Date of Patent: Dec. 1, 2015

(54) LOCK

(75) Inventor: Wilhelm Dück, Lubeck (DE)

(73) Assignee: Frinova GmbH, Pansdorf (DE)

( * ) Notice: Subject to any disclaimer, the term of this patent is extended or adjusted under 35 U.S.C. 154(b) by 155 days.

(21) Appl. No.: 13/879,154

(22) PCT Filed: Oct. 10, 2011

(86) PCT No.: PCT/EP2011/067655
§ 371 (c)(1),
(2), (4) Date: Apr. 12, 2013

(87) PCT Pub. No.: WO2012/049127
PCT Pub. Date: Apr. 19, 2012

(65) Prior Publication Data

US 2013/0192315 A1 Aug. 1, 2013

(30) Foreign Application Priority Data

Oct. 12, 2010 (EP) ..... 10013521

(51) Int. Cl.
*E05B 65/10* (2006.01)
*E05B 13/00* (2006.01)
(Continued)

(52) U.S. Cl.
CPC ..... *E05B 65/1086* (2013.01); *E05B 13/004* (2013.01); *E05B 55/00* (2013.01); *E05B 63/16* (2013.01); *E05B 65/0053* (2013.01); *E05B 63/0017* (2013.01); *E05B 65/1053* (2013.01); *E05B 77/06* (2013.01); *Y10T 70/5159* (2015.04)

(58) Field of Classification Search
CPC . E05B 63/0017; E05B 65/1053; E05B 77/06; E05B 47/026; E05B 65/1086; E05B 65/0053; E05B 13/004; E05B 55/00; E05B 63/16; Y10T 70/5159
USPC ..... 70/92, 465, 129, 134; 292/92, DIG. 65, 292/137, 139, 140, 143
See application file for complete search history.

(56) References Cited

U.S. PATENT DOCUMENTS 2,426,041 A * 8/1947 Moorhouse ..... 292/93
2,738,665 A * 3/1956 North et al. ..... 70/480
(Continued)

FOREIGN PATENT DOCUMENTS

AT 399 532 B 5/1995
DE 429 316 C 8/1926
(Continued)

*Primary Examiner* — Suzanne Barrett
*Assistant Examiner* — Morgan McClure
(74) *Attorney, Agent, or Firm* — McGlew and Tuttle, P.C.

(57) ABSTRACT

A lock, which is designed as a panic lock for a door of freezing room, includes a chassis (1, 2) and a latch bolt (3), which is displaceably guided into the chassis, impinged upon by a spring force in the direction of extension and beveled at least on one side. A two-part nut is rotationally mounted inside the lock. The inside part is able to be actuated by an inner operating lever, including an inner catch which enables the latch bolt (3) to be actuated at least in the insertion direction. An outer nut part (7), which can be actuated by an outer operating lever, includes an outer catch (10) enabling the latch bolt (3) to be actuated in the insertion and extraction direction. When the operating lever is not actuated, structure (15, 16) places the catch (10) of the nut part (7) in a neutral position in which the catch (10) is not in contact with the latch bolt (3). Structure (21-24) are also provided for locking the outer catch (10) in the neutral position thereof.

16 Claims, 5 Drawing Sheets

(51) Int. Cl.

| | |
|---|---|
| ***E05B 55/00*** | (2006.01) |
| ***E05B 63/16*** | (2006.01) |
| ***E05B 65/00*** | (2006.01) |
| *E05B 77/06* | (2014.01) |
| *E05B 63/00* | (2006.01) |

(56) References Cited

U.S. PATENT DOCUMENTS

| | | | | | |
|---|---|---|---|---|---|
| 2,762,642 | A | * | 9/1956 | Jewett | 292/92 |
| 2,886,363 | A | * | 5/1959 | Blumenthal | 292/92 |
| 2,893,772 | A | * | 7/1959 | Edwards | 292/223 |
| 3,678,716 | A | * | 7/1972 | Cobb | 70/92 |
| 3,696,648 | A | * | 10/1972 | Horgan, Jr. | 70/92 |
| 3,702,549 | A | * | 11/1972 | Solovieff et al. | 70/134 |
| 3,765,198 | A | * | 10/1973 | Horgan, Jr. | 70/92 |
| 3,940,886 | A | * | 3/1976 | Ellingson, Jr. | 49/319 |
| 4,418,552 | A | * | 12/1983 | Nolin | 70/107 |
| 4,519,641 | A | * | 5/1985 | Fujiya | 292/127 |
| 4,540,207 | A | * | 9/1985 | Klasen et al. | 292/341.17 |
| 4,691,543 | A | * | 9/1987 | Watts | 70/143 |
| 4,763,934 | A | * | 8/1988 | Kaveney, Jr. | 292/21 |
| 4,969,343 | A | * | 11/1990 | Luker | 70/92 |
| 5,009,089 | A | * | 4/1991 | Lin | 70/114 |
| 5,765,410 | A | * | 6/1998 | Kwan et al. | 70/107 |
| 6,032,985 | A | * | 3/2000 | Cutter | 292/92 |
| 6,205,825 | B1 | * | 3/2001 | Haeck et al. | 70/92 |
| 6,247,342 | B1 | * | 6/2001 | Lilas | 70/106 |
| 6,354,121 | B1 | * | 3/2002 | Frolov | 70/277 |
| 6,390,514 | B1 | * | 5/2002 | Frolov | 292/92 |
| 6,622,534 | B1 | * | 9/2003 | Miller et al. | 70/92 |
| 6,941,778 | B2 | * | 9/2005 | Cowper | 70/129 |
| 7,926,315 | B2 | * | 4/2011 | Poletti | 70/107 |
| 8,061,165 | B1 | * | 11/2011 | Cassini | 70/99 |
| 8,419,086 | B2 | * | 4/2013 | Moon | 292/165 |
| 8,424,928 | B2 | * | 4/2013 | Lin | 292/92 |
| 2003/0131639 | A1 | * | 7/2003 | Segawa | 70/92 |
| 2006/0243008 | A1 | * | 11/2006 | Etlicher | 70/101 |
| 2007/0023431 | A1 | * | 2/2007 | Rouns | 220/210 |
| 2009/0113957 | A1 | * | 5/2009 | Kondratuk | 70/145 |
| 2010/0263418 | A1 | * | 10/2010 | Moon | 70/107 |
| 2012/0013135 | A1 | * | 1/2012 | Moon | 292/165 |
| 2012/0175892 | A1 | * | 7/2012 | Shen | 292/92 |
| 2012/0198896 | A1 | * | 8/2012 | Moon | 70/145 |

FOREIGN PATENT DOCUMENTS

| | | | |
|---|---|---|---|
| DE | 10 78 900 | B | 3/1960 |
| FR | 2 832 447 | A1 | 5/2003 |
| GB | 2 235 492 | A | 3/1991 |

* cited by examiner

LOCK

CROSS REFERENCE TO RELATED APPLICATIONS

This application is a United States National Phase Application of International Application PCT/EP2011/067655 filed Oct. 10, 2011, and claims the benefit of priority under 35 U.S.C. §119 of European Patent Application EP 10013521.9 filed Oct. 12, 2010, the entire contents of which are incorporated herein by reference.

FIELD OF THE INVENTION

The invention relates to a lock, in particular to a panic lock for a door of a refrigeration room or freezer room.

BACKGROUND OF THE INVENTION

Locks of this type on the one hand serve for being able to lock the door from the outside, so that no unauthorized person can enter from the outside, but also on the other hand to ensure that the door can always be opened from the inside. Such doors are applied for escape ways, emergency exits and likewise and in particular they are stipulated with regard to refrigeration rooms and freezer rooms, in order to ensure that a person accidentally shut inside can leave the room at any time.

Mortise locks which have this function are counted as belonging to the state of the art. They comprise a door handle on their inward and outward sides and these via a common square shank engage in a hub which is rotatably mounted within the lock. The hub comprises a catch, with which the latch bolt can be displaced into the opening position. A locking cylinder is integrated for the dead bolt function and this activates a dead bolt which is arranged parallel to the latch bolt, usually therebelow and which can be extended and retracted by way of turning the key in the cylinder lock. On the inward side, an operating element is fixedly connected to the cylinder lock, instead of the key, so that the door can be unlocked from the inside also without a key.

The disadvantage of this known lock, in particular if it is applied for the door of a refrigeration room or freezer room, is that two operating elements must always be actuated one after the other, in order to open the lock and thus the door. Firstly, the dead bolt is to be unbolted by way of the operating element arranged on the cylinder lock, whereupon the door handle located thereabove is to be actuated.

SUMMARY OF THE INVENTION

Against this background, it is an object of the invention to design a panic lock such that it can be operated from the inside, in a simpler, in particular intuitive manner.

The lock according to the invention, which in particular is envisaged and provided as a panic lock for a door of a refrigeration room or freezer room, comprises a chassis, in which a latch bolt which is bevelled on at least one side and is impinged by spring force in the extension direction, is displaceably guided. A hub is rotatably mounted within the lock and is designed in a divided manner and comprises an inward hub part (hub part on the inward side) which is actuatable via an inward operating lever. This inward hub part comprises a catch, with which the latch bolt is actuatable at least in the retraction direction. The other part of the hub is formed by the outward hub part (hub part on the outward side) actuatable via an outward operating lever and comprising an outward catch, with which the latch bolt can be actuated in the retraction and extension direction. Moreover, according to the invention, a neutral positioning means is provided within the lock, which, given a non-actuation of the operating lever, brings the catches of the hub parts into a neutral position, in which the catches are disengaged from the latch bolt. Moreover, a locking means is provided for locking the outward catch in the neutral position, and these can be operated from the outward side.

Outward and inward in the context of the invention are to be understood as direction specifications according to DIN 107. With a refrigeration room door which always opens to the outside, the outward part of the lock lies close to the outer side of the door, thus on the warm side, whereas the inward part lies close to the inner side directed to the room to be closed, thus on the cold side.

The basic concept of the lock according to the invention is to design the panic function of the lock as simple as possible, i.e. to permit an intuitive operation, as is particularly advantageous in panic situations, since it can be accomplished quasi without the person having to think. The lock according to the invention, even if it is locked from the outside, i.e. is bolted with regard to its operation, can also be opened from the inside at any time, and specifically by way of a simple actuation of the operating lever in the opening position. In this case, depending on the design of the operating lever, a commercially available door handle can be applied and this can be opened from the inside by way of simple pushing, as when opening a room door, independently of whether the lock has been bolted from the outer side or not. Not only is an increased security against erroneous operation ensured by way of this, but moreover there is the advantage also in practical operation that it is always only one operating lever which is to be actuated on the inner side.

The lock according to the invention is particularly advantageous for the door of a refrigeration room or freezer room, but however its application is not necessarily limited to this and it may also be used as a panic lock for other applications or also for other purposes.

With regard to the construction of the lock, it is particularly favorable if the latch bolt which is present in any case also forms the dead bolt, with which the lock can be brought into its bolting position in the strike plate. Thereby, the design of the lock mechanism is advantageously such that for the latch bolt, a first extension position is envisaged, in which only the latching function is effective, and that moreover a second extension position reaching beyond the first extension position is provided, which fulfils the bolting function. The first extension position thus encompasses the usual latching function, in which the latch bolt moves into the lock against spring force, typically when the door is closed, and the latch bolt with its oblique surface is pushed back by the strike plate. In the second extension position on the other hand, the latch bolt is pushed further into the strike plate, so that a bolting between the lock and the strike plate is effected, which is significantly more difficult to manipulate than the first extension position.

In particular, for the use of a lock for a door of a refrigeration room or freezer room, it is advantageous to design the latch bolt bevelled on both sides. Thereby, apart from the usual bevelling which on closing the door comes into contact with the outer side of the strike plate, in order to press the latch bolt into the lock against spring force, a bevelling is also provided on the other side and this is typically shorter and serves for mechanically pulling the door a little more onto the frame by way of the extension (which is to say the moving-out) of the latch bolt from the first extension position into the second extension position, by which means a particularly tight bearing contact is effected, which ensures that the door seals bear firmly and seal in a good manner over their complete length.

Advantageously, according to a further formation of the invention, not only is the outward, but also the inward catch is impingable in the extension direction, so that the latch bolt can also be brought from the inside into the second extension position. This is particularly advantageous if a person enters into the refrigeration room or freezer room and works there for a longer time and wishes to ensure a sealed closure during this time.

In order to provide a bolting of the lock from the outside in a simple design manner, according to a further development of the invention, a receiver for a locking cylinder is provided in the chassis of the lock and is designed such that the locking cylinder is only accessible from the outside, i.e. that it is only accessible from the outer side of the lock with a key. The lock in this region in contrast is designed in a closed-walled manner from the inner side. Such locking cylinders are inexpensively available and, as the case may be, can be combined with closure systems which are also applied in other locks. Thereby, the catch of the closure cylinder is arranged such that on rotation of the key, it actuates a mechanism within the lock and this mechanism locks or releases the outward hub part, and specifically in the neutral position of the outward catch, so that the actuation of the inward hub part and thus also of the catch is independent of this. Thus with the locking cylinder it is not a dead bolt which is extended out of the lock, as is normally the case, but in contrast it serves to fixing the outward hub part via a suitable locking mechanism, so that an actuation from the outside and thus an opening of the lock from the outside is no longer possible.

In order to guide the catches of the hub parts into their neutral position, according to a further development of the invention, each hub part is provided with a cam surface directed roughly tangentially to the rotation axis of the hub, on which surface a slide impinged by spring force bears, and this slide is displaceably guided within the chassis and is impinged by spring force obliquely to this cam surface, preferably at an angle of about 45° thereto. This slide which in the neutral position has a counter-surface bearing on the cam surface is designed and arranged such that it automatically sets the hub part with its catch back into the neutral position as is described in detail further below.

Usefully, a detent which fixes the catch of the respective hub part in its neutral position is provided within the lock. The catch is advantageously moved into this detent position by the slide, and the springs of the slide and detent are therefore to be designed such that the slide can automatically bring the catch of the associated hub part into the detent position.

The construction of the lock can be effected in a manner which is stable and particularly simple with regard to design, if according to a further development of the invention, the chassis comprises a carrier plate which carries the components of the lock and which is connected at a longitudinal side to a forend, as is common with mortise locks.

The lock is advantageously designed as a mortise lock so that it can also replace present locks as the case may be, if these are to be replaced by such a panic lock equipped with only one actuation lever. Thereby, the operating levers are advantageously formed by standard-compliant door handles, so that the lock can receive standard-compliant handle furnishings and can be applied in standard-compliant doors without special designs.

The invention is hereinafter explained in more detail by way of one embodiment shown in the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

The lock represented by way of the figures is, as in the case of a mortise lock, provided with a forend 1 which can be inserted into a standardised recess of a rebated or non-rebated door and fastened in this by way of the forend 1. The forend 1 and a carrier plate 2, which is arranged transversely thereto and is fixedly connected thereto, form the chassis of the lock which is surrounded by a closed (not represented in the Figures) rectangular housing, as is common with mortise locks.

Figure 1C:
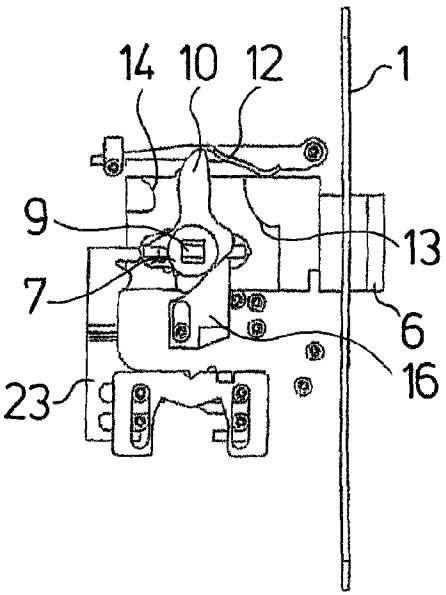
FIG. 1*c* is a greatly simplified representation showing the lock according to the invention in the non-actuated condition, and specifically an outward view, with a removed carrier plate.
Figure 1B:
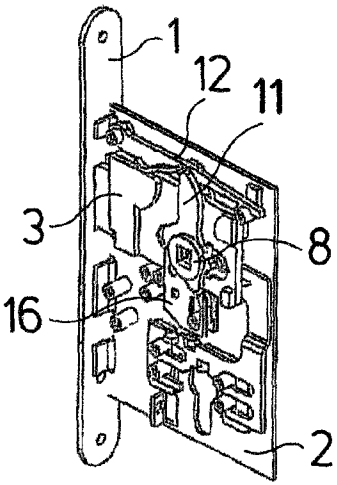
FIG. 1*b* is a greatly simplified representation showing the lock according to the invention in the non-actuated condition, and specifically a perspective inward view and obliquely to the rear.
Figure 1A:
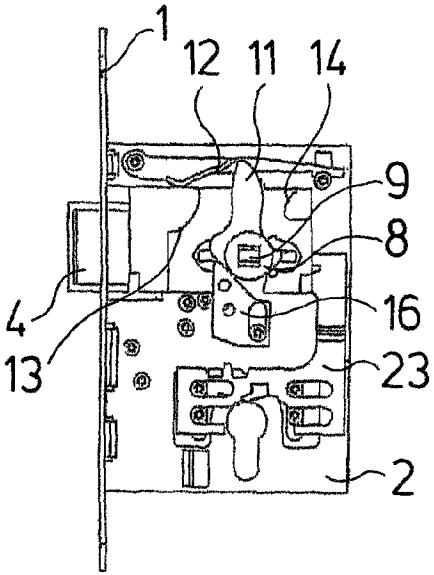
FIG. 1*a* is a greatly simplified representation showing a lock according to the invention in a non-actuated condition, and specifically in a view from inwards.

The lock comprises a latch bolt 3 which is bevelled on two sides, and comprises a first longitudinal oblique surface 4 which is arranged on the side facing inwards and is envisaged and provided for the common latch or catch function, when the door with the lock located therein is shut and the oblique surface 4 hits the outward side of the strike plate, by which means the latch bolt 3 is retracted against the spring force of the spring 5 through the forend 1 into the lock. After moving over the edge of the strike plate, the latch bolt 3 automatically extends or moves out again by the force of the spring 5 and holds the door in the closed position. This position (first extension position) is represented in FIGS. 1*a*-1*c*.

On the other side, the latch bolt 3 comprises a short oblique surface 6 which is shorter than the oblique surface 4 and is arranged on the outward side of the latch bolt 3. This oblique surface 6 serves for pressing the latch bolt 3 further into the strike plate when it has already snapped into the strike plate, wherein the latch bolt 3 by way of the oblique surface 6 together with the lock and the door, in which the lock is seated, is pulled into the door frame, by which means it is ensured that the door seal is impinged by force and this can be brought into bearing contact on all sides. With refrigeration room doors, the sealed state of the door is ensured by way of this and thus the cold flow via the door gap is prevented.

The oblique surfaces 4 and 6 extend almost up to the free outer end of the latch bolt 3. The oblique surface 4 thereby extends over almost the complete part of the latch bolt 3 which projects out of the forend 1 in the normal position, whereas the oblique surface 6 only extends over about half of this part and then merges into a part running in a straight line.

A hub which consists of two parts 7 and 8 and which is rotatably mounted within the carrier plate 2 or the lock housing is provided for the actuation of the lock. The outward hub part 7 comprises a central squared recess 9 which is provided for receiving an operating lever in the form of a door handle. The inward hub part 8 likewise comprises a central squared recess 9 which is envisaged for the positive-fit receiving of an inward operating lever in the form of a door handle arranged on the inner side of the door. The hub parts 7 and 8 can be moved independently of one another since they are separate from one another. Each hub part 7, 8 comprises a long catch 10 and 11 respectively, with which the latch bolt 3 can be locked and opened. With the position of the catches 10 and 11 shown by way of FIGS. 1*a*-1*c*, the hub parts 7 and 8 are in a neutral position, in which the respective catch 10, 11 is fixed by detent and is not actively connected to the latch bolt 3. The detent position is formed by a detent receiver 12 loaded by a spring force. Thereby, a common spring is provided for both catches 10 and 11.

In this neutral position, which is represented in FIGS. 1*a*-1*c*, the catches 10 and 11 are disengaged. The latch bolt likewise lies in the detent receiver 12 in a latching manner, so that it cannot be displaced further against the spring force of the spring 5.

The latch bolt 3 is formed within the lock housing by way of a sheet-metal part, in which recesses for mounting the hub parts 7 and 8 are formed and which comprises a surfaced recessing on the inward as well as on the outward side, for forming two cam tracks 13 and 14. Such cam tracks 13 and 14 are provided on the inward as well as on the outward side of the latch bolt 3 and lie such that they can come into active connection with the catches 10 and 11 at the respective side. Thereby, the long cam track 13 serves for moving the latch bolt out of the normal position (first extension position) into the bolting position (second extension position). The short cam track 14 or the projection which is formed by way of this in the latch bolt 3, serves for opening the lock, and specifically independently of whether this is located in the first or in the second extension position.

In the normal position, the lock is located in the representation according to FIGS. 1*a*-1*c*, and the latch bolt 3 is located in the first extension position, in which it is held by the force of the spring 5 and the detent receiver 12. In this position, the latch bolt 3 with regard to the cam tracks 13 and 14 is arranged at a distance to the respective catches 10 and 11, so that the latch bolt 3 can be pressed into the lock housing against spring force, in order to execute its latching function without contacting the catches 10, 11.

Figure 3C:
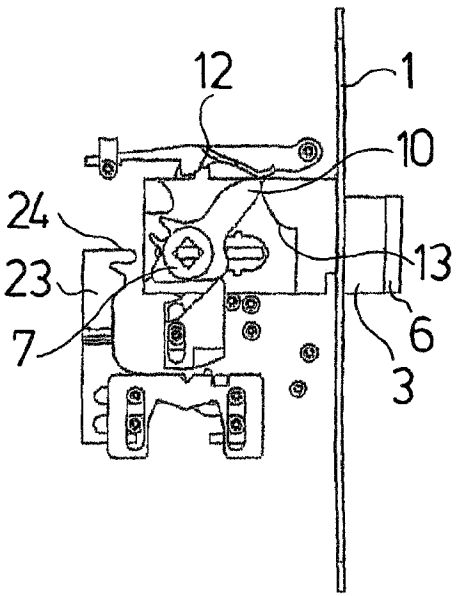
FIG. 3*c* is a greatly simplified representation showing the lock according to the invention in the locking position, and specifically an outward view, with a removed carrier plate.
Figure 3B:
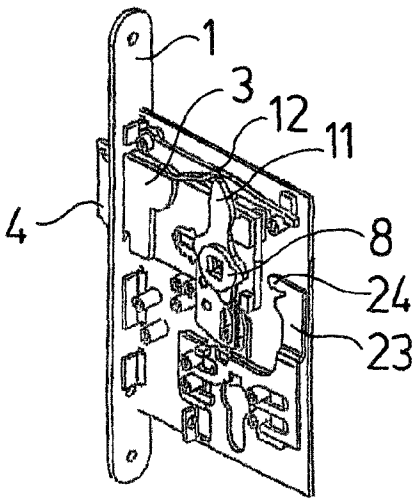
FIG. 3*b* is a greatly simplified representation showing the lock according to the invention in the locking position, and specifically a perspective inward view and obliquely to the rear.
Figure 3A:
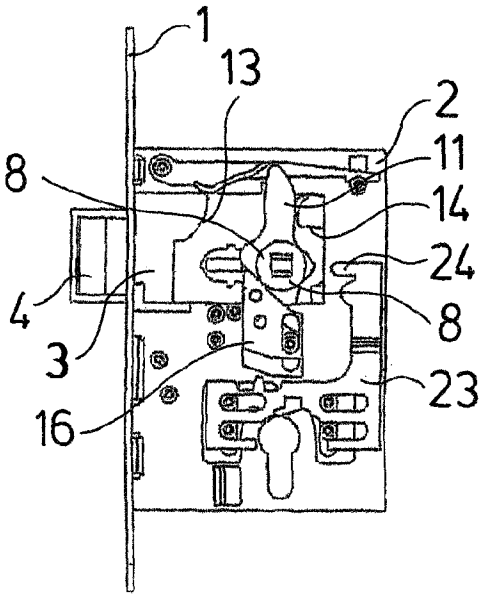
FIG. 3*a* is a greatly simplified representation showing the lock according to the invention in a locking position, and specifically in a view from inwards.

In FIGS. 3*a*-3*c*, the lock is represented in a position, in which it is brought into the bolted position, thus into the second extension position. This, as is shown in the representation according to FIG. 3*c*, is effected by way of actuating the outward door handle opposite to the opening direction, thus by way of pulling up the otherwise horizontal door handle. By way of this, the outward hub part 7 with the catch 10 located thereon is pivoted in FIG. 3*c* in the clockwise direction, by which means the catch 10 abuts on the upper end of the cam track 13 and with a further rotation moves the latch bolt 3 out of its first extension position (FIGS. 1*a*-1*c*) into the bolting position (second extension position), in which the oblique surface 6 pulls the latch bolt 3 with the lock and the door towards the door frame, and the latch bolt 3 moves out or extends to such an extent that it can be no longer manipulated from the outside. As FIG. 3*a* illustrates, the inward door handle with the hub part 8 remains in its neutral position independently of this movement. For the sake of completeness, it is to be noted here that this second extension position can also be effected by way of actuating the inner door handle, by way of pulling up the door handle, wherein the outer door handle then remains in its neutral position.

Figure 2C:
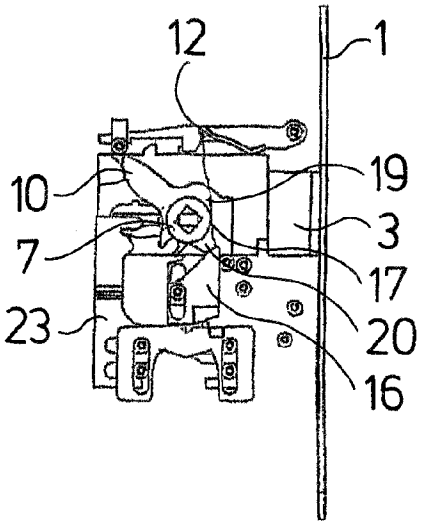
FIG. 2*c* is a greatly simplified representation showing the lock according to the invention in the opened position, and specifically an outward view, with a removed carrier plate.
Figure 2B:
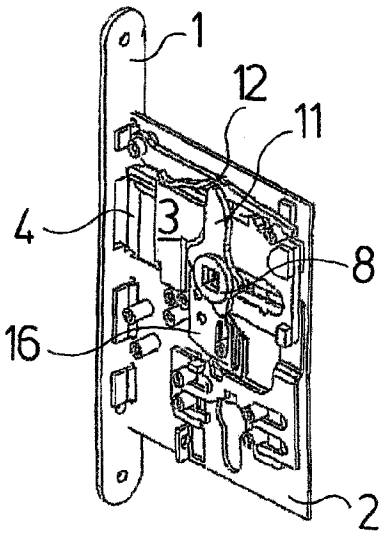
FIG. 2*b* is a greatly simplified representation showing the lock according to the invention in the opened position, and specifically a perspective inward view and obliquely to the rear.
Figure 2A:
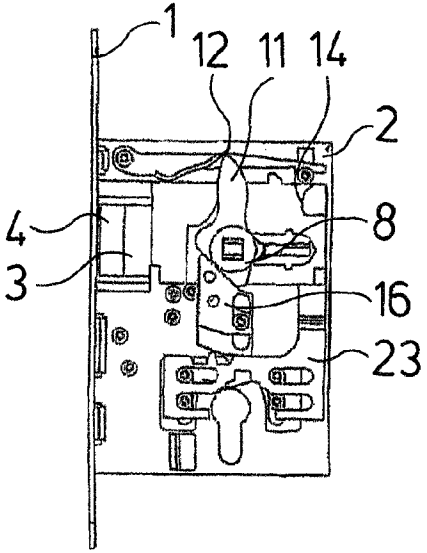
FIG. 2*a* is a greatly simplified representation showing the lock according to the invention in an opened position, and specifically in a view from inwards.

The latch bolt 3 can be opened from this second extension position as well as from the first extension position by way of actuating the inward door handle with the inward hub part 8 as well as by actuating the outward door handle with the outward hub part 7. FIGS. 2*a*-2*c* represent how the opening of the lock is effected, with which the outward door handle is actuated to open by way of the door handle being pushed downwards. Thereby, the latch bolt 3 is not only moved out of the second extension position, but also out of the first extension position, into the opened position, in which the latch bolt 3 lies completely within the lock and thus no longer passes through the forend 1 in a projecting manner. The movement of the latch bolt 3 in this case is effected by the outward catch 10 which comes to bear on the short cam track 14 and catches the latch bolt 3 in the retraction (moving-in) direction. As FIG. 2*a* illustrates, the catch 11 thereby remains on the other (inward) side in its neutral position in an unchanged manner. It is to be understood that this opening movement can be effected in the same manner by way of actuating the inward door handle, thus by pushing down the door handle which is located on the inner side of the door.

Two slides 16 are provided on both sides, in order to bring the outward hub part 7 and the inward hub part 8 into their neutral position, and these in the installed condition are essentially vertically displaceable and impinged by spring force by a spring 15 in the upward direction. In the installed condition they have an oblique surface 17 which is inclined by about 45° to the vertical and which is actively connected to an oblique surface 18, and this latter mentioned oblique surface is integrally formed in the hub parts 7 and 8 in each case and is directed essentially tangentially to the hub parts 7 and 8. These oblique surfaces 18 which extend in each case between two short catches 19 and 20, in combination with the oblique surface 18 on the respective slide 16, ensure that irrespective of the position of the hub parts 7 and 8, these are automatically brought into their neutral position, in which the catches 10 and 11 are disengaged from the latch bolt 3. In this position, the oblique surface 17 of the slide 16 bears on the oblique surface 18 of the associated hub in a surfaced manner.

Figure 5:
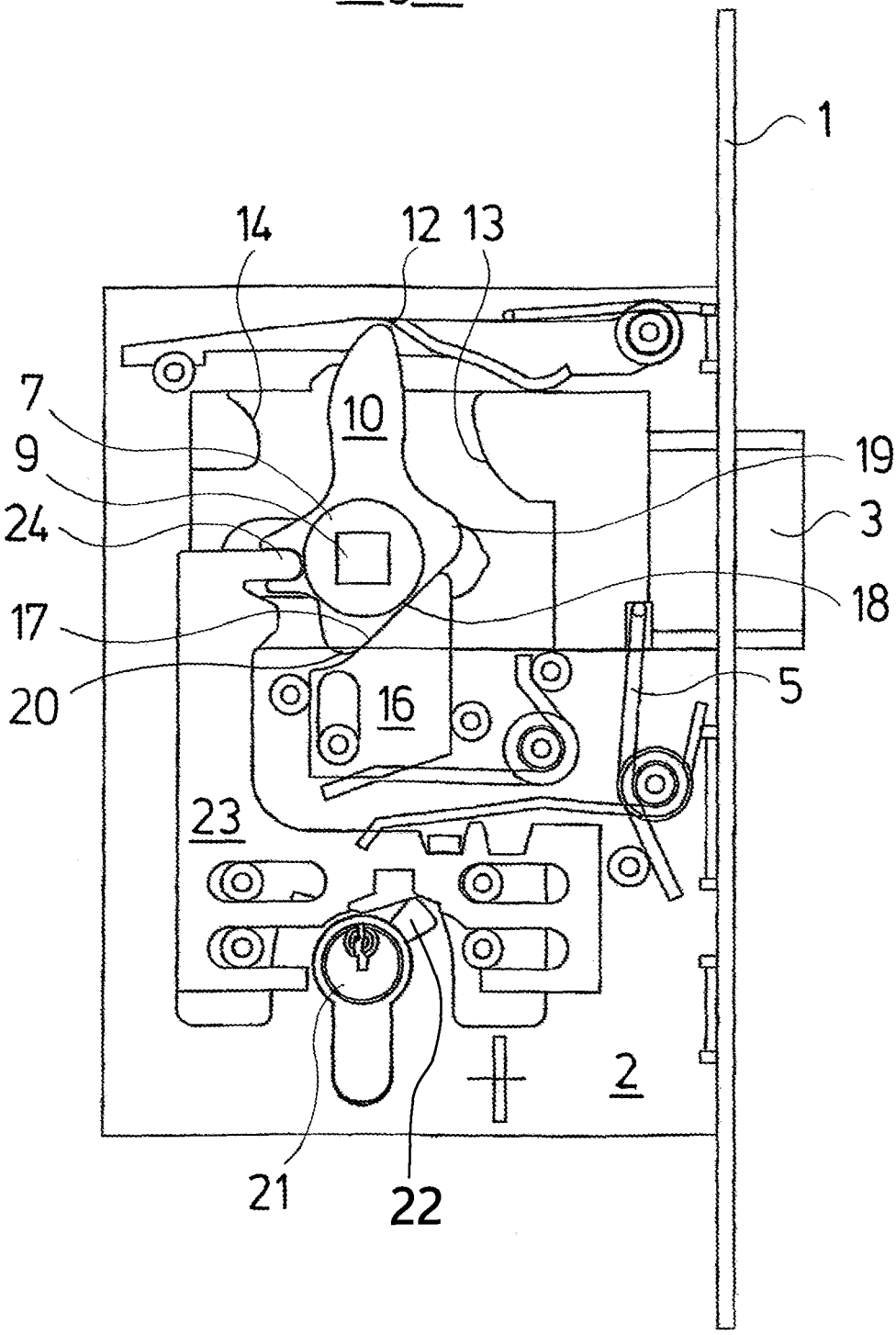
FIG. 5 is an enlarged outward view of the lock, showing the lock in the locking position and with a locking cylinder.

A locking cylinder 21 (FIG. 5) is integrated into the lock and is only accessible from the outward side, thus from the outer side of the door by way of a key, in order to secure the lock from entering form the outside. The inside of the lock is covered by the housing in this region, at the inward side. The locking cylinder 21 in a manner known per se comprises a catch 22 which on turning the key travels a path about the cylindrical part of the locking cylinder. The locking cylinder with the catch 22 is clearly visible in FIG. 5. The outward hub part 7 can be locked by way of the locking cylinder 21. For this, a sheet-metal part 23 is displaceable within the lock in the transverse direction, thus in a direction parallel to the movement direction of the latch bolt 3 and comprises a pawl 24, with which the outward hub part 7 can be locked, by way of the pawl 24 moving the direction of the forend 1 and thus fixing the hub part 7. For this, the catch 10 must however be located in its neutral position, since otherwise the pawl 24 cannot be introduced into the hub part 7. Thus by way of the closable locking cylinder 21, it is not a bolt which is moved into the strike plate which is otherwise common with locks, but it is exclusively the movement of the outward door handle and thus the actuation of the latch bolt 3 from the outside which is blocked.

Figure 4C:
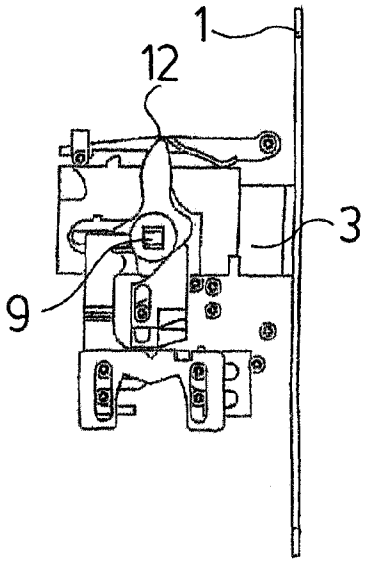
FIG. 4*c* is a greatly simplified representation showing the lock according to the invention in the emergency-opened position, and specifically an outward view, with a removed carrier plate.
Figure 4B:
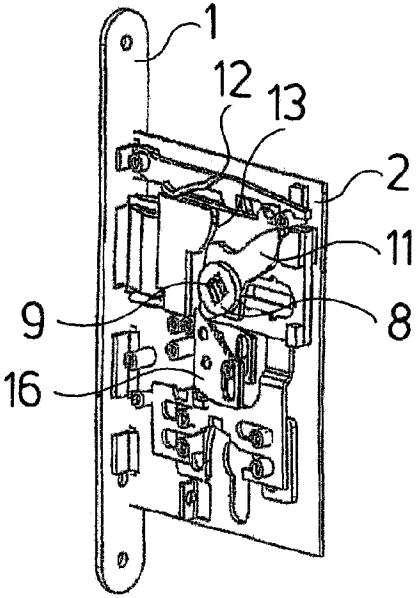
FIG. 4*b* is a greatly simplified representation showing the lock according to the invention in the emergency-opened position, and specifically a perspective inward view and obliquely to the rear.
Figure 4A:
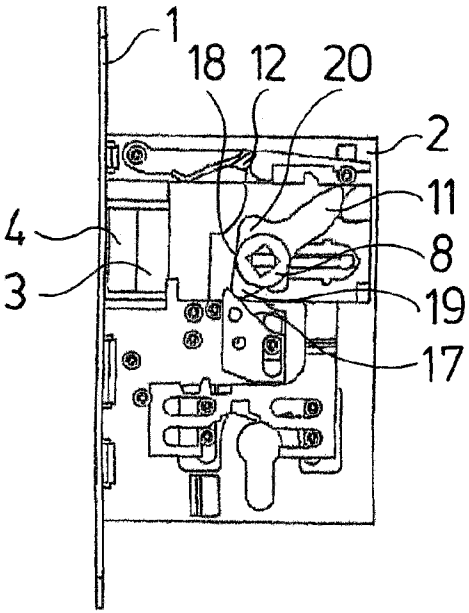
FIG. 4*a* is a greatly simplified representation showing the lock according to the invention in an emergency-opened position, and specifically in a view from inwards.

As is illustrated in FIGS. 4*a*-4*c*, given a blocked hub part 7 (see FIG. 4*c*), the latch bolt 3 also can be completely retracted into the lock housing and thus the door opened, via the inward hub part 8 and the door handle which is connected thereto, by way of simply pushing down the door handle. Thereby the movement of the door handle is effected onto the inward hub part 8, from there via the inward catch 11 onto the short cam track 14 and thus onto the latch bolt 3. Thereby, the locking of the outward hub part 7 remains unaffected.

While a specific embodiment of the invention has been shown and described in detail to illustrate the application of the principles of the invention, it will be understood that the invention may be embodied otherwise without departing from such principles.

The invention claimed is:

1. A panic lock for a door of a refrigeration room or freezer room, the lock comprising:

a chassis;

a latch bolt displaceably guided relative to the chassis, the latch bolt being biased by spring force in an extension direction and the latch bolt being bevelled on at least one side, wherein the latch bolt forms a dead bolt, and a first extension position is provided, in which only the latching function is effective, and a second extension position reaching beyond the first extension position is provided as a dead bolt function;

a rotatably mounted and divided hub, of which an inner hub part actuatable via an inner operating lever comprises an inner catch, with which the latch bolt can be actuated at least in a retraction direction, and of which the outer hub part actuatable via an outer operating lever comprises an outer catch, with which the latch bolt can be actuated in the retraction and extension direction;

neutral positioning means which, given a non-actuation of the operating levers, bring the catches of the hub parts into a neutral position, in which the catches are disengaged from the latch bolt; and locking means for locking the outward catch in the neutral position from outwards.

2. A lock according to claim 1, wherein the latch bolt is beveled on both sides.

3. A lock according to claim 1, wherein the latch bolt can also be acted on in the extension direction by way of the inner catch.

4. A lock according to claim 1, wherein only an outer receiver for a cylinder lock is provided in the chassis, and wherein the outer catch of the outer hub part can be locked or released in the neutral position via the catch of the cylinder lock.

5. A lock according to claim 1, wherein each hub part has a cam surface which is directed roughly tangentially to the rotation axis of the hub and on which a slide bears, said slide being biased by spring force obliquely to the cam surface, wherein the slide is designed and arranged such that the slide automatically sets the respective hub part back into the neutral position.

6. A lock according to claim 1, wherein a detent is provided, which fixes the catch of the hub part in the neutral position.

7. A lock according to claim 1, wherein the chassis comprises a carrier plate which is connected at a longitudinal side to a face plate.

8. A lock according to claim 1, wherein the lock is a mortise lock and the operating levers are formed by standard-conformable door handles.

9. A lock comprising:

a chassis;

a latch bolt moveably guided relative to the chassis, the latch bolt being biased by spring force in an extension direction and the latch bolt being bevelled on at least one side, wherein said latch bolt forms a dead bolt, and a first extension position is provided, in which only the latching function is effective, and a second extension position reaching beyond the first extension position is provided to provide a dead bolt function;

a rotatably mounted inward side hub part actuatable via an inward side operating lever, the inward side hub part comprising an inward side catch for displacing the latch bolt in a retraction direction;

a rotatably mounted outward side hub part actuatable via an outward operating lever, the outward side hub part comprising an outward side catch for displacing the latch bolt in the retraction and extension direction;

a neutral positioning arrangement moving the inward side catch and the outward side catch into a neutral position, in which the inward side catch and the outward side catch do not act on the latch bolt, with a non-actuation of the operating levers; and a locking arrangement locking the outward catch in the neutral position from the outward side.

10. A lock according to claim 9, wherein the latch bolt is beveled on both sides.

11. A lock according to claim 9, wherein the latch bolt is urged in the extension direction by the inward catch.

12. A lock according to claim 9, wherein:

only an outward side receiver for a cylinder lock is provided in the chassis wherein the outward side catch of the outward side hub part is locked or released in the neutral position via a catch of the cylinder lock.

13. A lock according to claim 9, wherein each of the inward side hub part and the outward side hub part has a cam surface directed approximately tangentially to the rotation axis of the respective hub and on which a slide bears, said slide being biased by spring force obliquely to the respective cam surface, wherein the slide automatically sets the respective hub part back into the neutral position.

14. A lock according to claim 9, further comprising a detent positioning the inward side catch and the outward side catch in the neutral position.

15. A lock according to claim 9, wherein the chassis comprises a carrier plate connected at a longitudinal side to a face plate.

16. A lock according to claim 9, wherein the lock is a mortise lock and the operating levers are formed by door handles.

* * * * *